US005252797A

United States Patent [19]

Komatsu

[11] Patent Number: 5,252,797

[45] Date of Patent: Oct. 12, 1993

[54] MICROWAVE OVEN WITH COOKING POT

[75] Inventor: Morimasa Komatsu, Ichinomiya, Japan

[73] Assignee: Kabushiki Kaisha Toshiba, Kawasaki, Japan

[21] Appl. No.: 910,659

[22] Filed: Jul. 8, 1992

[30] Foreign Application Priority Data

Aug. 9, 1991 [JP] Japan ..... 3-200269

[51] Int. Cl.[5] ..... H05B 6/76

[52] U.S. Cl. ..... 219/10.55 E; 219/10.55 C; 219/10.55 D

[58] Field of Search ..... 219/10.55 E, 10.55 F, 219/10.55 R, 10.55 C, 10.55 D; 99/DIG. 14, 451

[56] References Cited

U.S. PATENT DOCUMENTS 2,919,336 12/1959 Hahn ..... 219/10.55 R
2,956,144 10/1960 Woodman ..... 219/10.55 R

FOREIGN PATENT DOCUMENTS 1-285713 11/1989 Japan ..... 219/10.55 E
1-314823 12/1989 Japan ..... 219/10.55 E
2-116208 9/1990 Japan .
3-191212 8/1991 Japan ..... 219/10.55 E
3-254095 11/1991 Japan ..... 219/10.55 E

*Primary Examiner*—Philip H. Leung
*Attorney, Agent, or Firm*—Limbach & Limbach

[57] ABSTRACT

A microwave oven includes a casing, a cooking chamber defined by a metal wall in the casing having an upper opening, the cooking chamber having an upper opening, an outer lid mounted on the casing for closing and opening the upper opening of the cooking chamber the outer lid having a microwave shield in contact with the upper circumferential edge of the casing to thereby cover the upper opening of the casing, at a closing position of the outer lid, a microwave supply port formed in a bottom portion of the metal wall of the cooking chamber so as to face the interior of the cooking chamber, the microwave supply port being closed by a member formed from a microwave penetrable material a magnetron mounted in the casing and having a member delivering microwaves to the microwave supply port, a lid switch allowing the magnetron to be energized when the outer lid is closed and disallowing the magnetron to be energized when the outer lid is opened, a pot detachably mounted in the cooking chamber via its upper opening, the pot having an upper open end and being formed from a microwave-penetrable material, and an inner lid detachably mounted on the inside of the outer lid of the cooking chamber for closing the upper opening of the cooking chamber when the upper opening of the casing is closed by the outer lid.

5 Claims, 5 Drawing Sheets

MICROWAVE OVEN WITH COOKING POT

BACKGROUND OF THE INVENTION

1. Field of the Invention

This invention relates to a microwave oven which is suitable for cooking with a pot in particular.

2. Description of the Prior Art

FIG. 5 illustrates a conventional microwave oven of the general type. A casing 1 has a cooking chamber 2 formed in it. The cooking chamber 2 has a front opening which is closed and opened by a door 3. A magnetron (not shown) is energized to supply microwaves into the cooking chamber 2. A pot 4 formed from a microwave-penetrable material is sometimes used when boiling or stewing is performed with the microwave oven.

A problem arises when the pot 4 is used in boiling or stewing with the microwave oven. That is, a lid 5 is put on the pot 4 and then, the pot 4 is contained in the cooking chamber 2 for the microwave heating. Food in the pot 4 is usually stirred, another food is sometimes added or a user usually looks into the pot 4 to comprehend progress of cooking during the microwave heating. These works cannot be performed with the pot 4 contained in the cooking chamber 2. The pot 4 needs to be taken out of the cooking chamber 2 every time these works are performed, which results in troubles.

Japanese Laid-open Utility Model Reg. Application No. 2-116208 discloses a rice cooker wherein both of the heating by an electric heater and the heating by a magnetron can be performed. In this rice cooker, an inner receptacle with an upper opening is enclosed in a casing and a rice-cooking receptacle is then accommodated in the inner receptacle. A lid is provided for closing and opening the inner receptacle. The electric heater is mounted on a suitable portion of the casing. A microwave generator comprises the magnetron, a fan, a waveguide and a microwave supply port. The microwave generator is detachably mounted on the casing.

In the above-described rice cooker, the microwave generator is attached to the casing of the rice cooker when the microwave heating is to be executed. The waveguide of the microwave generator faces the interior of the inner receptacle from upward through the inside of the inner receptacle lid when the microwave generator is attached to the casing.

In accordance with the above-described rice cooker, the lid cannot be opened unless the microwave generator is detached from the casing. This causes much trouble when the food in the rice-cooking receptacle is stirred or when the user looks into the rice-cooking receptacle for comprehending the progress of the cooking during the microwave heating.

SUMMARY OF THE INVENTION

Therefore, an object of the present invention is to provide a heating apparatus by means of microwaves wherein when the cooking is performed with a pot, the food in the pot can be readily stirred during the cooking of the user can readily look into the pot for comprehending the progress of the cooking during the cooking.

The present invention provides a heating apparatus by means of microwaves comprising a casing having an upper opening, a cooking chamber defined by a metal wall in the casing, the cooking chamber having an upper opening, an outer lid mounted on the casing for closing and opening the upper opening of the cooking chamber, the outer lid having microwave shielding means in contact with the upper circumferential edge of the casing to thereby cover the upper opening of the casing, at a closing position of the outer lid, a microwave supply port formed in a bottom portion of the metal wall of the cooking chamber so as to face the interior of the cooking chamber, the microwave supply port being closed by a member formed from a microwave-penetrable material, a magnetron provided in the casing and having a member delivering microwaves to the microwave supply port, the member being disposed below the microwave supply port, a lid switch allowing the magnetron to be energized when the outer lid is closed and disallowing the magnetron to be energized when the outer lid is opened, a pot detachably provided in the cooking chamber via the upper opening thereof, the pot having an upper open end and being formed from a microwave-penetrable material, and an inner lid detachably mounted on the inside of the outer lid of the cooking chamber for closing the upper opening of the cooking chamber when the upper opening of the casing is closed by the outer lid.

Energizing the magnetron is disallowed when the outer lid is opened, and the user can look into the cooking chamber from above. Furthermore, the opening and closing of the outer lid are not obstructed by the magnetron and the waveguide since the microwaves are supplied to the cooking chamber through its portion thereof except for the upper opening thereof. Consequently, when stirring the food in the pot, adding another food into the pot or looking into the pot for comprehending the progress of the cooking, the user can do these works without taking the pot out of the cooking chamber.

A packing member may be provided along the peripheral edge of the inner lid so that the packing member is brought into close contact with the underside of the outer lid and an upper edge of the pot. Consequently, broth or other soup can be prevented from falling out of the pot.

Other objects of the present invention will become obvious upon understanding of the illustrative embodiment about to be described. Various advantages not referred to herein will occur to one skilled in the art upon employment of the invention in practice.

BRIEF DESCRIPTION OF THE DRAWINGS

An embodiment of the invention will be described with reference to the accompanying drawings in which.

DESCRIPTION OF THE PREFERRED EMBODIMENT

Figure 1:
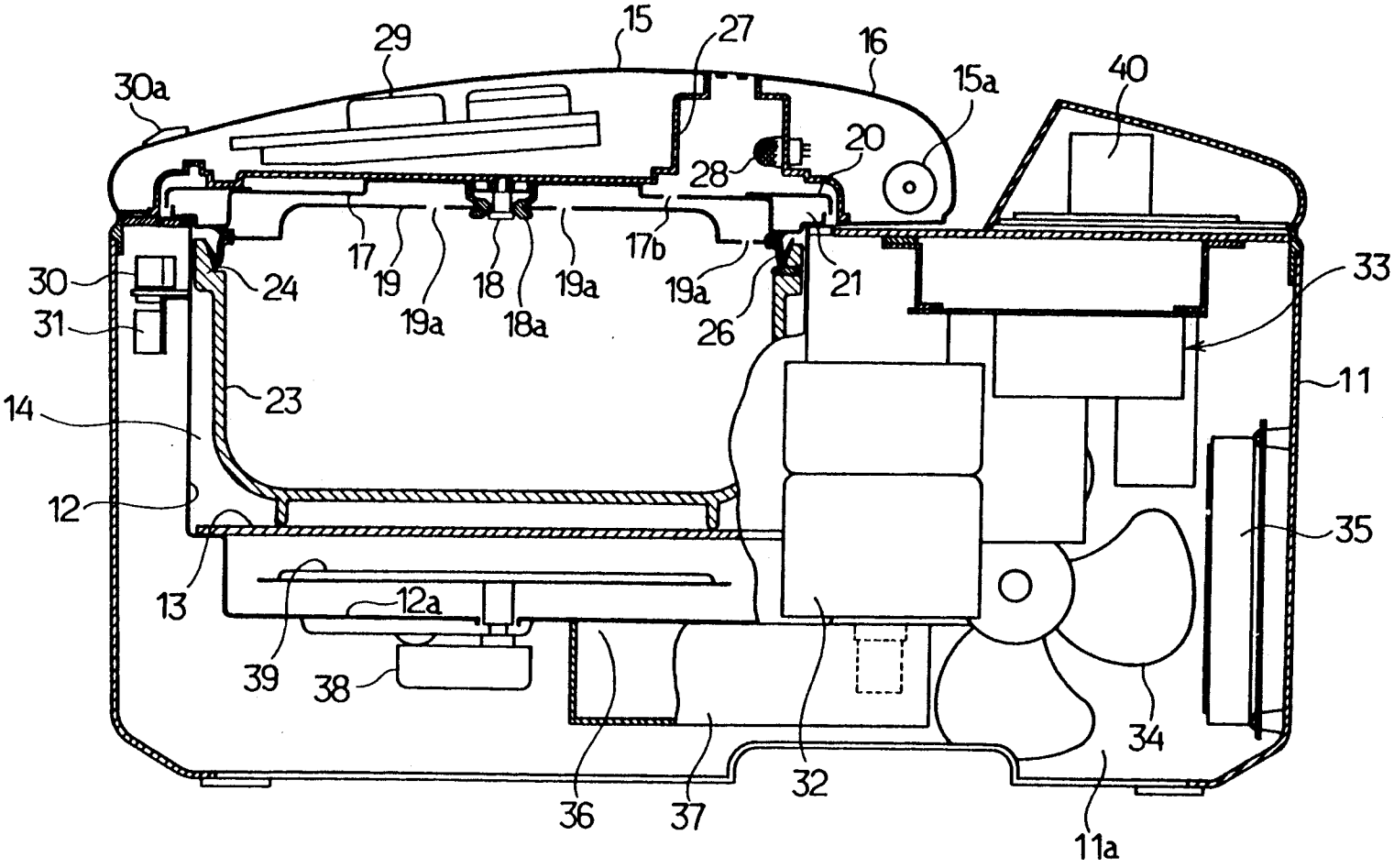
FIG. 1 is a schematically longitudinal sectional view of a microwave oven in accordance with one embodiment of the invention.

The embodiment of the present invention will be described with reference to FIGS. 1 through 4. Referring to FIG. 1, a casing 11 of the microwave oven is formed of a plastic material. A generally receptacle-shaped wall 12 formed from a metallic material is provided in the left-hand interior of the casing 11 as viewed in FIG. 1. The wall 12 has a circumferential stepped portion at the lower inner portion thereof. A bottom plate 13 is horizontally mounted on the stepped portion of the wall 12. The bottom plate 13 is formed from a microwave-penetrable material such as ceramics. A cooking chamber 14 with an upper opening is thus defined by the wall 12 and the bottom plate 13. The wall 12 and the bottom plate 13 are water-tightly sealed by sealing members (not shown).

An outer lid 15 is mounted on a hinge 15*a* for opening and closing the upper opening of the cooking chamber 14. The outer lid 15 has a double-wall construction and comprises an outer lid member 16 formed of a plastic material and an inner lower cover 17 (the cooking chamber side) formed from a metallic material. Alternatively, both of the outer lid member 16 and the inner lower cover 17 may be formed from the metallic material.

The lower cover 17 has a support pin 18 secured to the central portion of the underside thereof and projecting toward the interior of the cooking chamber 14. A packing 18*a* is fitted with the support pin 18 and an inner lid 19 formed from a metallic material is detachably mounted on the support pin 18 with the packing 18*a* interposed therebetween.

Figure 2:
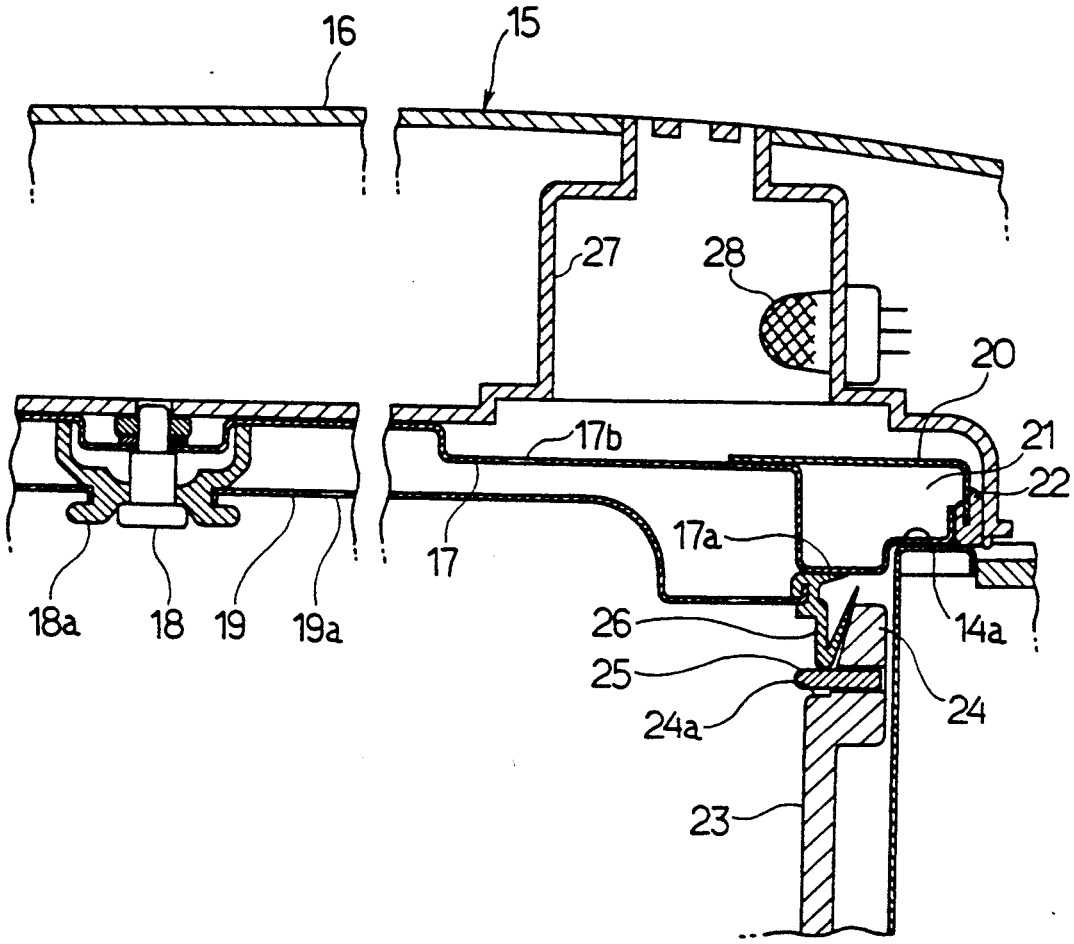
FIG. 2 is a partial longitudinal sectional view of the upper portion of the microwave oven.

Referring to FIG. 2, a cavity 21 for absorbing the microwaves is formed along the peripheral edge of the lower cover 17 by a concave wall portion 17*a* and a closing plate 20. A joint 22 is provided between the concave wall portion 17*a* and the closing plate 20. The joint 22 is formed from a ferrite as a microwave-absorbing material. The underside of the concave wall portion 17*a* collides with a flange 14*a* of the upper edge of the wall 12 when the outer lid 15 is closed.

Figure 3:
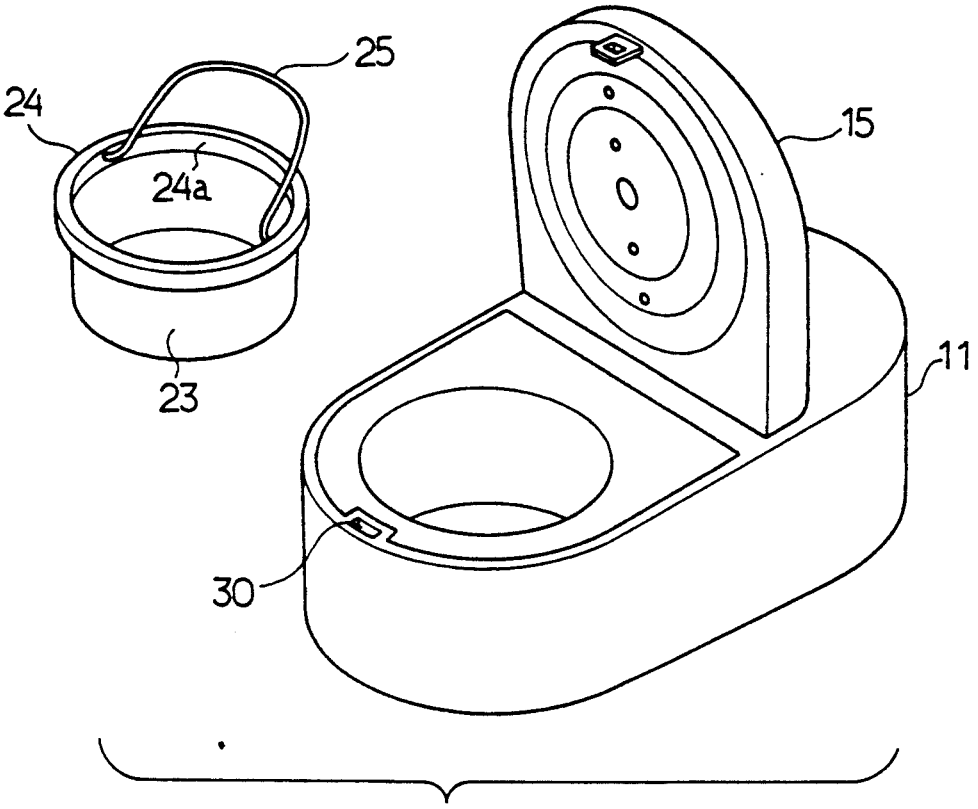
FIG. 3 is a schematically perspective view of the microwave oven with a pot detached.

A pot 23 with an upper opening is put into and taken out of the cooking chamber 14 through the upper opening of the cooking chamber 14. The plot 23 is formed from the microwave-penetrable material. The pot 23 has a flange 24 formed along the upper edge thereof. The flange 24 is slightly directed outwardly. A grip 25 is rotatively mounted on the flange 24, as is shown in FIG. 3. The grip 25 is disposed at the stepped portion 24*a* of the flange 24 when the pot 23 is not used. The upper opening of the pot 23 placed in the cooking chamber 14 is closed and opened by the inner lid 19 with its rotative movement.

A packing 26 is attached along the circumferential edge of the inner lid 19. As shown in FIG. 2, the packing 26 is pressed by the concave wall portion 17*a* when the outer lid 15 is closed. Consequently, the packing 26 is brought into close contact with the underside of the outer lid 15 and inner circumferential surface of the flange 24 of the pot 23.

Steam-passing apertures 19*a* and 17*b* are formed in the inner lid 19 and the lower cover 17 respectively. The outer lid 15 is provided with a steam escape cylinder 27. A steam sensor 28 is provided for sensing steam in the steam escape cylinder 27.

An operation switch section 29 is provided in the outer lid 15 so as to be externally operable. A lock section 30 is provided in the casing 11 for locking the outer lid 15 at its closed state. Furthermore, an unlocking button 30*a* is mounted on the lid 15 and a lid switch 31 is provided in the casing 11 for detecting the opening and closure of the outer lid 15.

A magnetron 32 is mounted on the wall 12 in a machine compartment 11*a* defined in the right-hand interior of the casing 11 as viewed in FIG. 1. A magnetron drive section 33, a cooling fan 34 and a cord take up reel 35 are provided in the machine compartment 11*a*.

A microwave supply port 36 is formed in a bottom portion 12*a* of the wall 12. A waveguide 37 communicates the microwave supply port 36 to a microwave output section of the magnetron 32. The microwave supply port 36 is usually closed by the bottom plate 13 serving as the member comprising a microwave-penetrable material.

A stirrer fan motor 38 is also provided on the outside of the bottom 12*a* of the wall 12. A stirrer fan 39 driven by the motor 38 is provided on the inside of the bottom 12*a* of the wall 12. A microcomputer-based control section 40 is provided on the top of the casing 11 for controlling the operation of the microwave oven.

Figure 4:
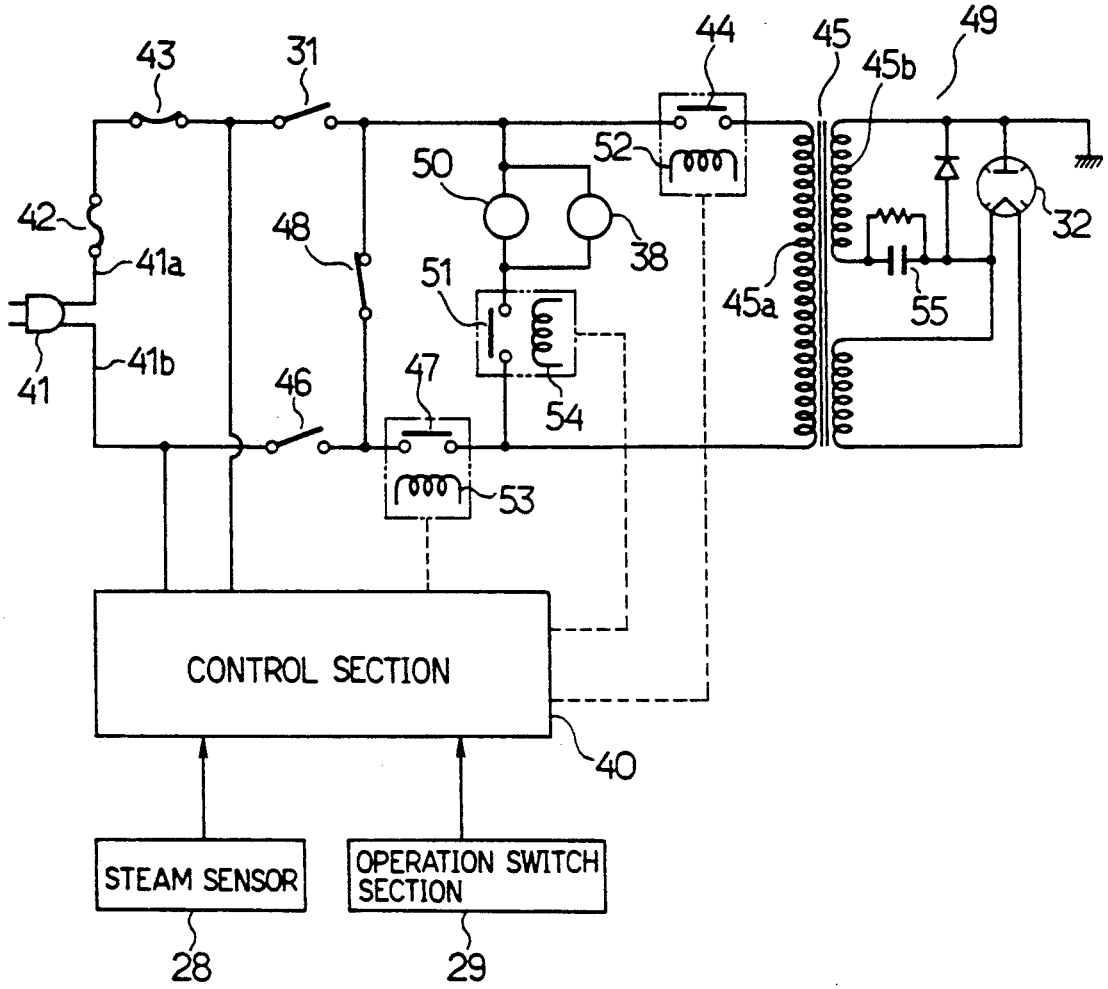
FIG. 4 is a circuit diagram showing an electrical arrangement of the microwave oven.
Figure 5:
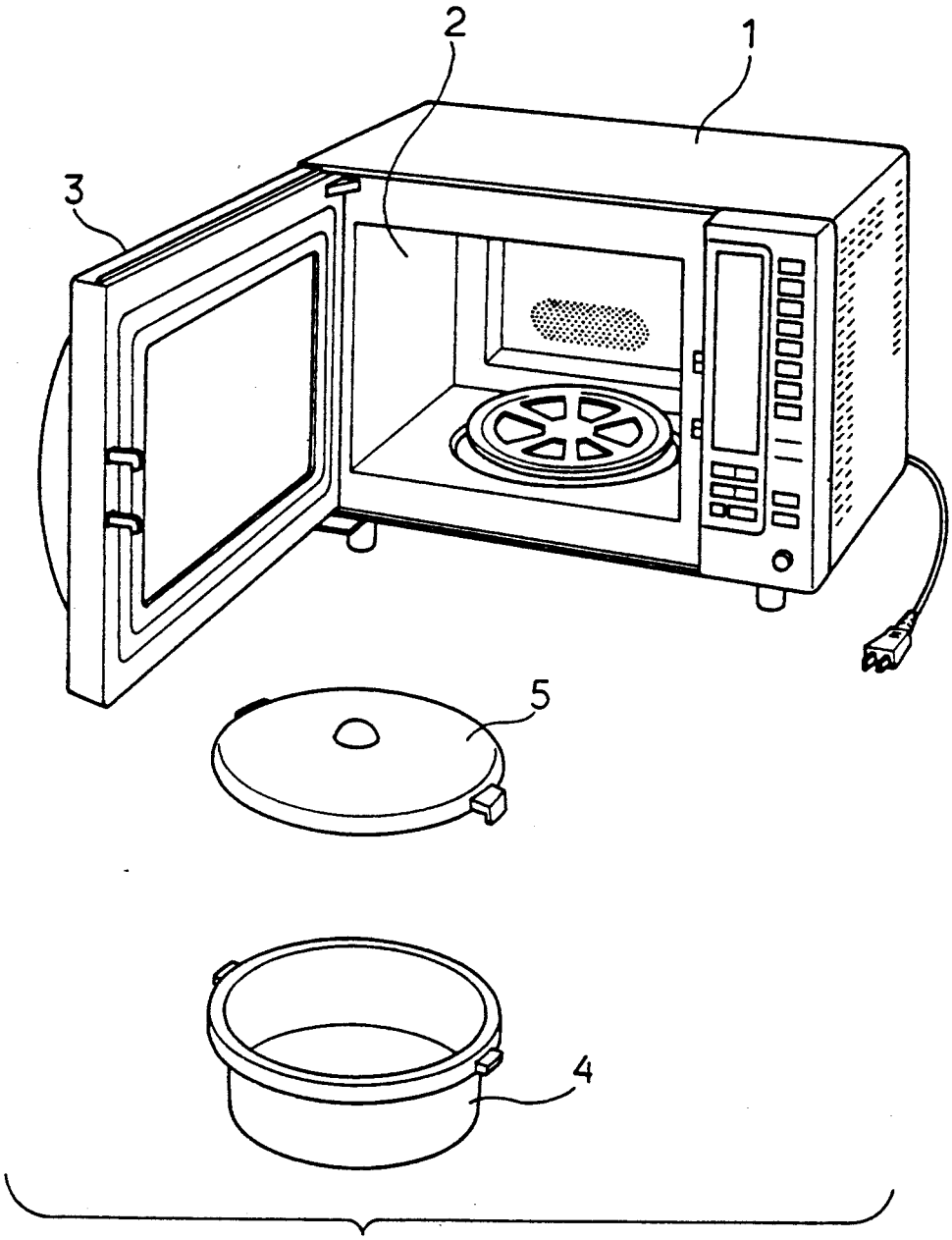
FIG. 5 (PRIOR ART)
FIG. 5 is a view similar to FIG. 3 showing a conventional construction.

An electrical arrangement of the microwave oven will be described with reference to FIG. 4. One end of a primary coil 45*a* of a high voltage transformer 45 is connected to a power supply line 41*a* which is further connected to one terminal of a power supply plug 41, via a fuse 42, a thermal switch 43, the lid switch 31 and a relay switch 44 for power adjustment. The other end of the primary coil 45*a* is connected to a power supply line 41*b* which is further connected to the other terminal of the power supply plug 41, via a switch 46 operated in response to the lid switch 31 and a main relay switch 47. The lid switch 31 and the switch 46 are turned on and a monitor switch 48 is turned off when the outer lid 15 is closed. A secondary coil 45*b* of the high voltage transformer 45 is connected to a magnetron drive circuit 49 provided in the magnetron drive section 33. A DC output supplied from the secondary coil 45*b* through a rectifier circuit 55 is applied across the anode and the cathode of the magnetron 32. A fan motor 50 driving the cooling fan 34 is connected via a relay switch 51 between the power supply side of the relay switch 44 and the other side of the primary coil 45*a*. The fan motor 50 is connected in parallel with the stirrer fan motor 38. The control section 40 is provided with a power supply circuit (not shown) converting an AC power supplied thereto from control power supply lines 41*a* and 41*b* to a DC control power. Furthermore, the microcomputer of the control section 40 controls the relays 52, 53 and 54 in accordance with an operational program, thereby on-off controlling the respective relays switches 44, 47 and 51.

The operation of the microwave oven will now be described. Opening the lid 15, the user takes the pot 23 out of the cooking chamber 14 with the knob 25 held. The user puts food to be cooked into the pot 23 and then, returns the pot 23 into the cooking chamber 14, closing the outer lid 15. Consequently, the upper opening of the pot 23 is closed by the inner lid 19. Furthermore, upon closure of the outer lid 15, the lid switch 31 and the switch 46 are turned on and the monitor switch 48 is turned off, so that energizing the magnetron 32 is allowed. When switches of the operation switch section 29 are operated, the magnetron 32 initiates its oscillating operation and the fan motor 50 and the stirrer fan motor 38 are driven.

The microwaves generated by the magnetron 32 are supplied into the cooking chamber 14 through the waveguide 37 and the microwave supply port 36. In this case the microwaves are supplied, diffused by the stirrer fan motor 38. The microwaves pass through the bottom plate 13 and penetrate into the pot 23, heating the food therein. A part of steam induced in the pot 23 is discharged outwards through steam-passing apertures 19*a* and 17*b* and the steam escape cylinder 27 in turn. The steam is sensed by the steam sensor 28 when passing through the steam escape cylinder 27. Based on the result of the sensing of the steam, the control section 40 controls the subsequent heating period of time and the heating power in accordance with the predetermined program, then completing the cooking operation.

The outer lid 15 is opened when the food in the pot 23 is stirred, another food is added into the pot 23 or the progress of the cooking is comprehended during the cooking operation. The lid switch 31 is turned off upon the opening of the outer lid 15, so that energizing the magnetron 32 is disallowed. Consequently, the drive of the magnetron 32 is interrupted. Opening the outer lid 15, the user can look into the pot 23 in the cooking chamber 14 from above. Accordingly, the user can do the works as described above in the midway of the cooking operation without taking the pot 23 out of the cooking chamber 14. Furthermore, since the microwave supply port 36 is formed in the bottom of the wall 12 or in the lower portion of the cooking chamber, the user can open and close the outer lid 15 without being obstructed by the magnetron 32, the waveguide 37 or the like. Additionally, since the microwaves are irradiated over the interior of the cooking chamber 14 from below, the uniform heating can be facilitated.

The pot 23 is provided for an exclusive use in the microwave oven of the present invention. Thus, the convenience of the microwave oven can be improved since a commercially available pot need not be prepared. The commercially available pot may not be suitable for the microwave oven of the present invention according to circumstances, resulting in an inconvenience. However, such an inconvenience can be eliminated in the microwave oven of the present invention.

The inner lid 19 is provided on the underside of the outer lid 15, for opening and closing the upper opening of the pot 23. Thus, since the pot 23 is closed by the inner lid 19, a satisfactory cooking can be performed. Furthermore, since the inner lid 19 is detachably attached to the outer lid 15, the inner lid 19 can be opened together with the outer lid 15, which can further improve the convenience. The inner lid 19 can be cleaned readily when detached from the outer lid 15.

The packing 26 is attached along the circumferential edge of the inner lid 19. The packing 26 is brought into close contact with the underside of the outer lid 15 and the upper circumferential edge of the pot 23. Consequently, broth or other soup can be prevented from falling out of the pot 23 during the cooking.

Furthermore, the microwaves can be reliably prevented from leaking out of the cooking chamber 14 since the cooking chamber 14 is defined by the receptacle-shaped metal wall 12 and the metal lower cover 17 of the outer lid 15.

The outer lid 15 can be opened and closed with safety since the lid switch 31 is operated to allow the energization of the magnetron 32 when the outer lid 15 is closed and to disallow the energization of the magnetron 32 when the outer lid 15 is opened.

The pot 23 can be readily taken out of the cooking chamber 14 since it is provided with the grip 25 in the embodiment, especially. Furthermore, the grip 25 can be raised up and retracted. In the case where the grip 25 is retracted when the pot 23 is accommodated in the cooking chamber 14, the accommodation of the pot 23 is not prevented by the grip 25.

Although the microwave supply port 36 is provided in the lower portion of the cooking chamber 14 in the foregoing embodiment, it may be provided in the other portion except for the upper opening of the cooking chamber 14. For example, the microwave supply port 36 may be provided in the inner side wall of the cooking chamber 14.

The foregoing disclosure and drawings are merely illustrative of the principles of the present invention and are not to be interpreted in a limiting sense. The only limitation is to be determined from the scope of the appended claims.

I claim:

1. A heating apparatus by means of microwaves comprising:

a) a casing having an upper casing;

b) a cooking chamber defined by a metal wall in the casing, the cooking chamber having an upper opening;

c) an outer lid mounted on the casing for closing and opening the upper opening of the cooking chamber, the outer lid having microwave shielding means in contact with the upper circumferential edge of the casing to thereby cover the upper opening of the casing, at a closing position of the outer lid;

d) a microwave supply port formed in a bottom portion of the metal wall of the cooking chamber so as to face the interior of the cooking chamber, the microwave supply port being closed by a member formed from a microwave-penetrable material;

e) a magnetron provided in the casing and having a member delivering microwaves to the microwave supply port, the member being disposed below the microwave supply port;

f) a lid switch allowing the magnetron to be energized when the outer lid is closed and disallowing the magnetron to be energized when the outer lid is opened;

g) a pot detachably provided in the cooking chamber via the upper opening thereof, the pot having an upper open end and being formed from a microwave-penetrable material; and h) an inner lid detachably mounted on the inside of the outer lid of the cooking chamber for closing the upper opening of the cooking chamber when the upper opening of the casing is closed by the outer lid.

2. A heating apparatus according to claim 1, further comprising a packing member provided along the peripheral edge of the inner lid so that the packing member is brought into contact with the underside of the outer lid and an upper edge of the pot.

3. A heating apparatus according to claim 1, wherein the cooking chamber comprises a generally receptacle-shaped metal wall and a bottom plate disposed in the lower interior of the cooking chamber, the bottom plate being formed from a microwave-penetrable material and the microwave supply port is formed in the bottom of the metal wall and the microwave delivering member comprises a waveguide extending from the magnetron and having an extending end positioned at the bottom plate.

4. A heating apparatus according to claim 1, wherein the outer lid has a double-wall construction, at least a portion of the outer lid at the cooking chamber side is formed from a metal, and the outer lid has an operation switch section therein.

5. A heating apparatus according to claim 1, wherein the microwave delivering member comprises a waveguide extending from the magnetron and having an extending end positioned below the microwave supply port.

* * * * *